US009689261B2

(12) United States Patent
Kumar

(10) Patent No.: US 9,689,261 B2
(45) Date of Patent: Jun. 27, 2017

(54) STACKED WHEEL ASSEMBLY FOR A ROTOR OF A ROTARY MACHINE

(71) Applicant: General Electric Company, Schenectady, NY (US)

(72) Inventor: Rajesh Kumar, Karnataka (IN)

(73) Assignee: General Electric Company, Schenectady, NY (US)

( * ) Notice: Subject to any disclaimer, the term of this patent is extended or adjusted under 35 U.S.C. 154(b) by 849 days.

(21) Appl. No.: 14/076,475

(22) Filed: Nov. 11, 2013

(65) Prior Publication Data

US 2015/0128611 A1 May 14, 2015

(51) Int. Cl.
*F01D 5/06* (2006.01)

(52) U.S. Cl.
CPC ..... *F01D 5/066* (2013.01)

(58) Field of Classification Search
CPC ..... F01D 5/066
USPC ..... 411/166, 84, 85, 90, 191, 192
See application file for complete search history.

(56) References Cited

U.S. PATENT DOCUMENTS 4,405,285 A * 9/1983 Surdi ..... F01D 5/326 411/107
4,488,844 A * 12/1984 Baubles ..... F16B 37/045 411/103
6,784,597 B1 * 8/2004 Hess ..... F01D 5/066 310/320
2013/0034402 A1 2/2013 Ferslew et al.

* cited by examiner

*Primary Examiner* — Janie Loeppke
(74) *Attorney, Agent, or Firm* — Ernest G. Cusick; Frank A. Kachur

(57) ABSTRACT

A stacked wheel assembly for a rotor of a rotary machine includes a plurality of stacked wheels for rotation about a common axis and forming a portion of the rotor. Also included is a tie bolt passing through aligned bolt holes of the plurality of stacked wheels for retaining the plurality of stacked wheels in axially stacked relation, the tie bolt extending out of a forward end of a forward wheel of the plurality of stacked wheels and out of an aft end of an aft wheel of the plurality of stacked wheels. Further included is a rotor component disposed adjacent the aft end of the aft wheel. Yet further included is a nut mounted within a forward face of the rotor component, the nut configured to be in threaded engagement with the tie bolt to exert a clamping force on the plurality of stacked wheels.

11 Claims, 5 Drawing Sheets

STACKED WHEEL ASSEMBLY FOR A ROTOR OF A ROTARY MACHINE

BACKGROUND OF THE INVENTION

The subject matter disclosed herein relates to a rotary machine and, more particularly, to a tie bolt and stacked wheel assembly for the rotors of such machines.

The rotors of rotary machines, such as turbines and compressors, are typically formed of axially stacked wheels, which hold individual blades about their periphery. For example, compressor rotors include a series of individual compressor wheels stacked together with a set of tie bolts extending generally axially through the stack. The wheels mount the blades which, together with stator blades, form the compressor stages. The tie bolts are typically elongated studs threaded at both ends for receiving nuts to maintain the wheels in stacked, assembled relation relative to one another. Loosening of the nuts on the tie bolts reduces the tension on the bolts, thereby lowering the torque carrying capability of the rotor, eventually to unacceptable levels.

Traditionally, nuts are designed as hollow cylinders with internal threads. The circular face of the nut is pressed against a rotor surface to transfer a clamp load in a substantially axial direction. Positioning of the cylindrical nuts against the rotor surfaces requires additional space, thereby leading to an undesirable effect of the presence of a kink or step in the rotor midsection structure. The kink or step reduces the overall bending stiffness of the rotor and may lead to high gravity sag and high cycle fatigue stress.

BRIEF DESCRIPTION OF THE INVENTION

According to one aspect of the invention, a stacked wheel assembly for a rotor of a rotary machine includes a plurality of stacked wheels for rotation about a common axis and forming a portion of the rotor. Also included is a tie bolt passing through aligned bolt holes of the plurality of stacked wheels for retaining the plurality of stacked wheels in axially stacked relation, the tie bolt extending out of a forward end of a forward wheel of the plurality of stacked wheels and out of an aft end of an aft wheel of the plurality of stacked wheels. Further included is a rotor component disposed adjacent the aft end of the aft wheel. Yet further included is a nut mounted within a forward face of the rotor component, the nut configured to be in threaded engagement with the tie bolt to exert a clamping force on the plurality of stacked wheels.

According to another aspect of the invention, a nut for a rotary machine includes a threaded hole configured to engage a tie bolt passing through aligned bolt holes of a plurality of stacked wheels. Also included is a dovetail region for engaging a slot of a rotor component disposed adjacent an aft end of an aft wheel of the plurality of stacked wheels, the slot comprising a corresponding geometry for receiving the nut therein, wherein the dovetail region of the nut axially retains the nut within the rotor component.

According to yet another aspect of the invention, a rotary machine includes a compressor section, a combustor assembly, and a turbine section. Also included is a rotor operatively coupling the compressor section and the turbine section. Further included is a plurality of stacked wheels for rotation about a common axis and forming a portion of the rotor within the compressor section. Yet further included is a tie bolt passing through aligned bolt holes of the plurality of stacked wheels for retaining the plurality of stacked wheels in axially stacked relation, the tie bolt extending out of an aft end of an aft wheel of the plurality of stacked wheels. Also included is a rotor component disposed adjacent the aft end of the aft wheel. Further included is a nut mounted within a forward face of the rotor component, the nut configured to be in threaded engagement with the tie bolt to exert a clamping force on the plurality of stacked wheels.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of a turbine system. The terms "radial" and "radially" as used in this application refer to directions and orientations extending substantially orthogonally to the center longitudinal axis of the turbine system. The terms "upstream" and "downstream" as used in this application refer to directions and orientations relative to an axial flow direction with respect to the center longitudinal axis of the turbine system.

Figure 1:
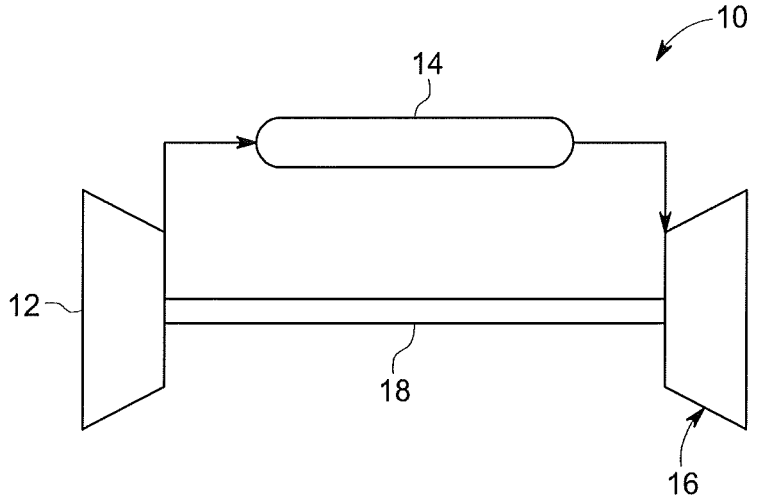
FIG. 1 is a schematic illustration of a gas turbine engine.

Referring to FIG. 1, a rotary machine, such as a gas turbine engine, for example, is schematically illustrated with reference numeral 10. The gas turbine engine 10 includes a compressor section 12, a combustor assembly 14, a turbine section 16, and a rotor 18. It is to be appreciated that one embodiment of the gas turbine engine 10 may include a plurality of compressors 12, combustors 14, turbines 16, and rotors 18. The compressor section 12 and the turbine section 16 are coupled by the rotor 18.

Figure 2:
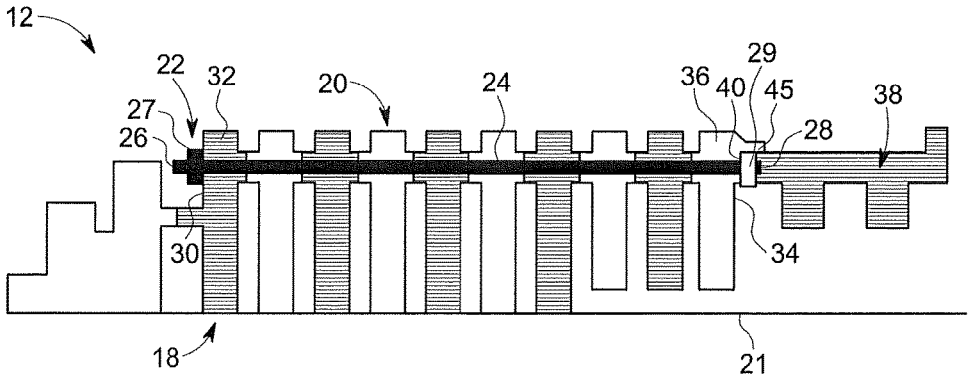
FIG. 2 is a schematic illustration of a plurality of stacked wheels forming a portion of a rotor of the gas turbine engine.
Figure 5:
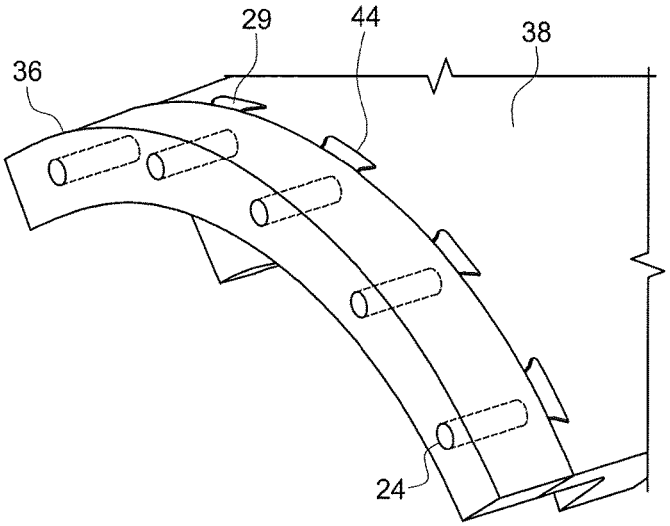
FIG. 5 is a partial perspective view of the plurality of nuts in threaded engagement with a plurality of tie bolts according to the embodiment of FIG. 3.

Referring to FIG. 2, a portion of the rotor 18 is illustrated in more detail. The illustrated portion is a plurality of wheels 20 axially stacked in the compressor section 12, with the wheels configured to rotate about a common axis 21 and to have a plurality of circumferentially spaced compressor blades (not shown) mounted thereto at a radially outer portion of each wheel. Although described and illustrated in relation to the compressor section 12, it is to be understood that the embodiments described herein may be employed in the turbine section 16 of the gas turbine engine 10. The plurality of wheels 20 are maintained in their axially stacked relation by a tie bolt assembly 22. Although a single tie bolt assembly is illustrated in FIG. 2, it is to be appreciated that the plurality of wheels are axially clamped with a plurality of circumferentially spaced tie bolt assemblies (FIG. 5). The tie bolt assembly 22 includes a tie bolt 24 that extends axially along the length of the compressor section 12. In the illustrated embodiment, the tie bolt 24 extends the full length of the compressor section 12, thereby passing through all of the plurality of wheels 20 of the compressor section 12, but it is to be appreciated that the tie bolt 24 may only pass through a portion of the plurality of wheels 20, thereby requiring multiple tie bolts at each circumferential location.

The tie bolt 24 is a mechanical fastener and may be characterized as an elongated stud having a first end 26 and a second end 28. As shown, the first end 26 protrudes slightly and extends out of a forward end 30 of a forward wheel 32 of the plurality of wheels 20. The second end 28 protrudes slightly and extends out of an aft end 34 of an aft wheel 36 of the plurality of stacked wheels 20. The tie bolt 24 is locked in place, thereby axially clamping the plurality of stacked wheels 20, with respective locking components at the first end 26 and the second end 28. In particular, the locking components include a forward nut 27 and an aft nut 29 that are each threaded and configured to engage threaded regions of the tie bolt 24 proximate the first end 26 and the second end 28. The nuts may be different in structure and the aft nut 29 is configured to engage the second end 28 of the tie bolt 24, which will be described in detail below. As shown, the aft wheel 36 of the tie bolt 24 is disposed adjacent a rotor structure 38 that may be referred to as a "mid-section structure" of the rotor 18. The rotor structure 38 is located at the aft end 34 of the plurality of stacked wheels 20 and is disposed between, and operatively couples, the compressor section 12 and the turbine section 16. The aft nut 29 is mounted within a forward face 40 of the rotor structure 38.

Figure 3:
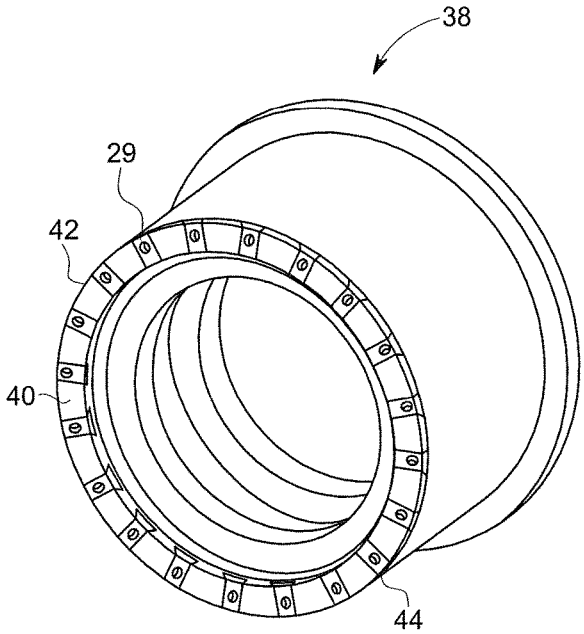
FIG. 3 is a perspective view of a plurality of nuts disposed within a rotor component according to a first embodiment.
Figure 4:
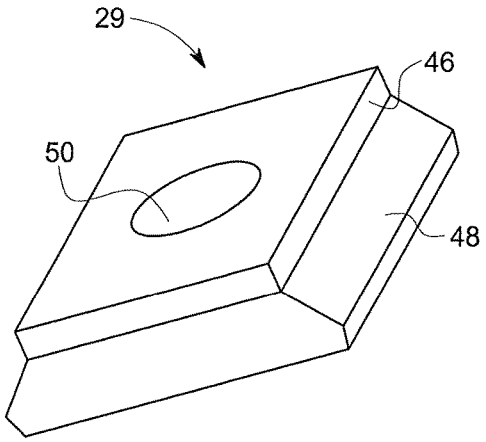
FIG. 4 is a perspective view of one of the plurality of nuts according to the embodiment of FIG. 3.

Referring now to FIGS. 3 and 4, the rotor structure 38 and the aft nut 29 are illustrated in greater detail. The rotor structure 38 is a cylindrical structure with the forward face 40 of a forward flange 42 located adjacent to the aft end 34 of the aft wheel 36 of the plurality of wheels 20. As shown, the rotor structure 38 is configured to receive a plurality of aft nuts within the forward flange 42 and to axially retain the plurality of aft nuts therein. In the embodiment illustrated, the aft nut 29 is loaded radially into a slot 44 of the forward flange 42. The aft nut 29 includes a first portion 46, a second portion 48, and a threaded hole 50 extending axially through the first portion 46 and the second portion 48. The threaded hole 50 is configured to engage the second end 28 of the tie bolt 24 to exert a clamping force on the plurality of wheels 20. The first portion 46 and the second portion 48 of the aft nut 29 may be formed of numerous geometries. It is to be appreciated that the first portion 46 and the second portion 48 are merely distinct geometries, with the second portion 48 typically having a larger cross-sectional area than the first portion 46 in order to facilitate axial retention of the aft nut 29 in the slot 44 of the forward flange 42 of the rotor structure 38. The slot 44 includes a geometry corresponding to the aft nut 29. In the illustrated embodiment, the aft nut 29 is formed as having a substantially dovetail region as the second portion 48. In this manner, the aft nut 29 is radially loaded into the slot 44 and retained therein similar to the manner in which a bucket is loaded into a wheel. However, as noted above, the specific geometries of the aft nut 29 and the slot 44 may vary from that described above and illustrated. A flange or rabbet 45 may be included proximate the outer region of the aft wheel 36 to radially retain and/or seal the aft nut 29 (FIG. 2).

Figure 6:
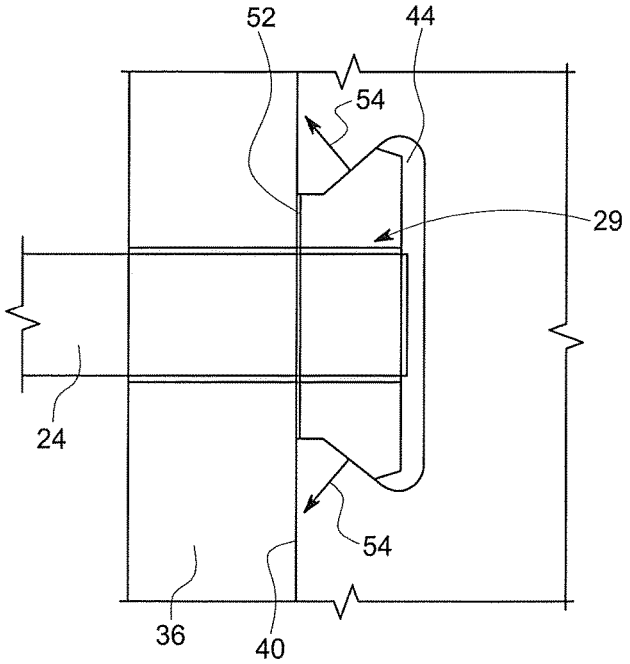
FIG. 6 is an enlarged, side view of one of the plurality of nuts in threaded engagement with one of the plurality of tie bolts according to the embodiment of FIG. 3.

Referring to FIGS. 5 and 6, the aft nut 29 is shown engaged with the second end 28 of the tie bolt 24. The aft nut 29 is illustrated in a fully inserted condition within the slot 44 and is fully disposed within the slot 44. In particular, the aft nut 29 is dimensioned to maintain a forward edge 52 axially rearward of the forward face 40 of the rotor structure 38. In this manner, the aft nut 29 is not in contact with the aft end 34 of the aft wheel 36, such that the force exerted by the aft nut 29 is not directly along the axis of the tie bolt 24, but rather along load paths 54. Such an arrangement provides sufficient clamping force to maintain the plurality of wheels 20 in an axially stacked relationship, while eliminating or reducing the space requirement for a nut to be placed in contact with the aft wheel 36 and forward of the rotor structure 38. Additionally, positioning of the aft nut 29 as described above avoids a kink or step in the rotor structure 38 that is otherwise present. A reduction in high cycle fatigue stress is achieved by avoiding the kink or step and increases the rotor stack stiffness.

Figure 7:
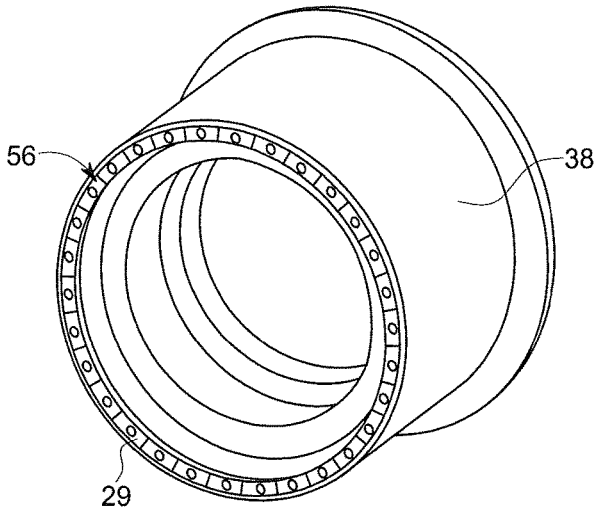
FIG. 7 is a perspective view of the plurality of nuts disposed within the rotor component according to a second embodiment.
Figure 8:
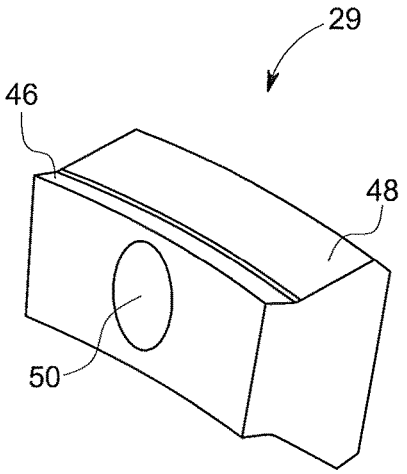
FIG. 8 is a perspective view of one of the plurality of nuts according to the embodiment of FIG. 7.
Figure 9:
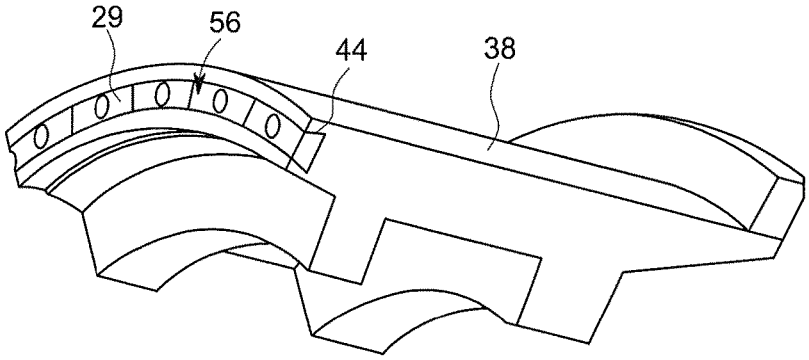
FIG. 9 is a partial perspective view of the plurality of nuts disposed within the rotor component according to the embodiment of FIG. 7.

Referring to FIGS. 7-9, an alternative embodiment of the rotor structure 38 and the aft nut 29 is illustrated. In contrast to the radially loaded nut of the embodiments described above, the illustrated embodiments include a circumferentially loaded nut. The slot 44 of the rotor structure 38 is aligned to receive the aft nut 29 in a circumferential direction and axially retain the aft nut 29 therein. The aft nut 29 is similar to the above-described embodiments, but is simply oriented to be loaded circumferentially into the slot 44. Specifically, the aft nut 29 still includes the first portion 46, the second portion 48 and the threaded hole 50. Although loading a single nut at a time is contemplated, typically a nut segment 56 having a plurality of nuts is circumferentially loaded into the slot 44. Loading slots and circumferential locking features (not shown) are typically employed for such an embodiment.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A stacked wheel assembly for a rotor of a rotary machine comprising:

a plurality of stacked wheels for rotation about a common axis and forming a portion of the rotor;

a tie bolt passing through aligned bolt holes of the plurality of stacked wheels for retaining the plurality of stacked wheels in axially stacked relation, the tie bolt extending out of a forward end of a forward wheel of the plurality of stacked wheels and out of an aft end of an aft wheel of the plurality of stacked wheels;

a rotor component disposed adjacent the aft end of the aft wheel, the rotor component comprising at least one slot that extends around a forward face of the rotor component; and at least one nut mounted within a forward face of the rotor component, the at least one nut configured to be in threaded engagement with the tie bolt to exert a clamping force on the plurality of stacked wheels, wherein the at least one nut includes a dovetail region for engaging and being fully disposed in the at least one slot of the rotor component, wherein the at least one slot comprises a plurality of radially extending slots, each of the plurality of radially extending slots configured to receive one nut of the at least one nut in a radial direction.

2. The stacked wheel assembly of claim 1, wherein the at least one nut is fully disposed within the forward face of the rotor component.

3. The stacked wheel assembly of claim 1, wherein the rotor component comprises a mid-section structure disposed between, and operatively coupling a compressor section of the rotary machine and a turbine section of the rotary machine.

4. The stacked wheel assembly of claim 3, wherein the plurality of stacked wheels is disposed in the compressor section.

5. The stacked wheel assembly of claim 1, further comprising a plurality of circumferentially spaced tie bolts.

6. The stacked wheel assembly of claim 1, further comprising a flange extending from the aft end of the aft wheel, the flange in contact with the at least one nut and configured to radially retain the at least one nut within the forward face of the rotor component.

7. A stacked wheel assembly for a rotor of a rotary machine comprising:

a plurality of stacked wheels for rotation about a common axis and forming a portion of the rotor;

a tie bolt passing through aligned bolt holes of the plurality of stacked wheels for retaining the plurality of stacked wheels in axially stacked relation, the tie bolt extending out of a forward end of a forward wheel of the plurality of stacked wheels and out of an aft end of an aft wheel of the plurality of stacked wheels;

a rotor component disposed adjacent the aft end of the aft wheel, the rotor component comprising at least one slot that extends around a forward face of the rotor component; and at least one nut mounted within a forward face of the rotor component, the at least one nut configured to be in threaded engagement with the tie bolt to exert a clamping force on the plurality of stacked wheels, wherein the at least one nut includes a dovetail region for engaging and being fully disposed in the at least one slot of the rotor component, wherein the at least one slot comprises a circumferentially extending slot configured to receive the at least one nut in a circumferential direction.

8. The stacked wheel assembly of claim 7, wherein the circumferentially extending slot is configured to receive a nut segment having a plurality of nuts.

9. A rotary machine comprising:

a compressor section;

a combustor assembly;

a turbine section;

a rotor operatively coupling the compressor section and the turbine section;

a plurality of stacked wheels for rotation about a common axis and forming a portion of the rotor within the compressor section;

a tie bolt passing through aligned bolt holes of the plurality of stacked wheels for retaining the plurality of stacked wheels in axially stacked relation, the tie bolt extending out of an aft end of an aft wheel of the plurality of stacked wheels;

a rotor component disposed adjacent the aft end of the aft wheel, the rotor component comprising at least one slot that extends around a forward face of the rotor component; and at least one nut mounted within a forward face of the rotor component, the at least one nut configured to be in threaded engagement with the tie bolt to exert a clamping force on the plurality of stacked wheels, wherein the at least one nut includes a dovetail region for engaging and being fully disposed in the at least one slot of the rotor component, wherein the at least one slot comprises a plurality of radially extending slots, each of the plurality of radially extending slots configured to receive one nut of the at least one nut in a radial direction.

10. The rotary machine of claim 9, wherein the at least one nut is fully disposed within the forward face of the rotor component.

11. A rotary machine comprising:

a compressor section;

a combustor assembly;

a turbine section;

a rotor operatively coupling the compressor section and the turbine section;

a plurality of stacked wheels for rotation about a common axis and forming a portion of the rotor with the compressor section;

a tie bolt passing through aligned bolt holes of the plurality of stacked wheels for retaining the plurality of stacked wheels in axially stacked relation, the tie bolt extending out of an aft end of an aft wheel of the plurality of stacked wheels;

a rotor component disposed adjacent the aft end of the aft wheel, the rotor component comprising at least one slot that extends around a forward face of the rotor component; and at least one nut mounted within a forward face of the rotor component, the at least one nut configured to be in threaded engagement with the tie bolt to exert a clamping force on the plurality of stacked wheels, wherein the at least one nut includes a dovetail region for engaging and being fully disposed in the at least one slot of the rotor component, wherein the at least one slot comprises a circumferentially extending slot configured to receive the at least one nut in a circumferential direction.

* * * * *